US006515265B2

(12) United States Patent
Sano

(10) Patent No.: US 6,515,265 B2
(45) Date of Patent: Feb. 4, 2003

(54) MICROWAVE OVEN IN WHICH RUSH CURRENT TO HIGH VOLTAGE TRANSFORMER IS SUPPRESSED

(75) Inventor: Masakazu Sano, Shiga (JP)

(73) Assignee: Sanyo Electric Co., Ltd., Moriguchi (JP)

( * ) Notice: Subject to any disclaimer, the term of this patent is extended or adjusted under 35 U.S.C. 154(b) by 0 days.

(21) Appl. No.: 09/938,730

(22) Filed: Aug. 27, 2001

(65) Prior Publication Data

US 2002/0023921 A1 Feb. 28, 2002

(30) Foreign Application Priority Data

Aug. 29, 2000 (JP) ..... 2000-258942(P)

(51) Int. Cl.[7] ..... H05B 6/68

(52) U.S. Cl. ..... 219/721; 219/716; 219/723; 219/710; 219/702

(58) Field of Search ..... 219/721, 715, 219/716, 723, 720, 710, 702; 363/49

(56) References Cited

U.S. PATENT DOCUMENTS

| | | | | | |
|---|---|---|---|---|---|
| 4,625,086 | A | * | 11/1986 | Karino | 219/720 |
| 5,317,115 | A | * | 5/1994 | Forsberg | 219/716 |
| 5,357,087 | A | * | 10/1994 | Choi | 219/721 |
| 5,777,301 | A | * | 7/1998 | Kim | 219/721 |
| 5,883,366 | A | * | 3/1999 | Park | 219/715 |

FOREIGN PATENT DOCUMENTS

| | | | | |
|---|---|---|---|---|
| JP | 2-160393 | | 6/1990 | |
| JP | 4-136623 | * | 5/1992 | 219/720 |

* cited by examiner

*Primary Examiner*—Philip H. Leung
(74) *Attorney, Agent, or Firm*—Armstrong, Westerman & Hattori, LLP

(57) ABSTRACT

When power supply to a high voltage transformer starts, the phase θ of the voltage of an AC power source when power supply to the high voltage transformer is stopped last time is referred to. In accordance with the value of the phase θ, the phase of the voltage of the AC power source when power supply to the high voltage transformer starts is determined, so that the peak value of the rush current in the high voltage transformer is minimized.

20 Claims, 11 Drawing Sheets

FIG.5A POWER SUPPLY VOLTAGE

FIG.5B RELAY DRIVING SIGNAL A

FIG.5C RELAY CONTACT STATE A

FIG.5D RELAY DRIVING SIGNAL B

FIG.5E RELAY CONTACT STATE B

FIG.5F RELAY DRIVING SIGNAL C

FIG.5G RELAY CONTACT STATE C

MICROWAVE OVEN IN WHICH RUSH CURRENT TO HIGH VOLTAGE TRANSFORMER IS SUPPRESSED

BACKGROUND OF THE INVENTION

1. Field of the Invention

The present invention relates to a microwave oven and, more specifically, to a microwave oven in which rush current to a high voltage transformer is suppressed.

2. Description of the Background Art

A microwave oven heats food, by oscillation of high frequency radio wave from a magnetron. In a microwave oven, a high voltage transformer is mounted to supply power to the magnetron.

As a magnetic material is used for the core of the transformer, the transformer has hysteresis characteristics in magnetic field H and magnetic flux density B (see R1 of FIG. 11A). FIG. 11B shows time change of voltage waveform (R2) and magnetic flux waveform (R3: current waveform) of the high voltage transformer.

In the transformer, the phase of the magnetic flux is advanced by $\pi/2$ from the voltage phase. As can be understood from FIG. 11A, excitation magnetic flux generated in the high voltage transformer changes from $-\Phi$ to $+\Phi$. As can be understood from FIG. 11B, when power supply to the high voltage transformer starts at a timing of point P or point Q where magnetic flux attains zero, that is, at the phase providing maximum voltage, the rush current generated in the high voltage transformer can be suppressed low.

Actually, power supply to the high voltage transformer is controlled by controlling ON/OFF of a power relay. It is often the case, however, that because of variations in the power relay operation time, the timing of power supply to the high voltage transformer varies, resulting in a large rush current generated in the high voltage transformer.

Japanese Patent Laying-Open No. 2-160393 discloses a technique to shorten the operation time of the power relay, in order to suppress variation of the operation time of the power relay.

The technique described in this laid-operation application, however, cannot by itself fully suppress the rush current at the start of power supply to the high voltage transformer.

SUMMARY OF THE INVENTION

Through intensive study, the inventors of the present invention came to a conclusion that in order to suppress rush current at the start of power supply to a high voltage transformer, it is necessary to control more accurately than in the prior art, the timing of power supply from an AC power source to the high voltage transformer. Further, it was found that the rush current at the start of power supply to the high voltage transformer is influenced by the state of residual magnetic flux at the high voltage transformer left when power supply to the high voltage transformer is stopped immediately before.

The present invention was made in view of the foregoing, and an object is to provide a microwave oven in which rush current in the high voltage transformer can be suppressed.

According to an aspect, the present invention provides a microwave oven including a magnetron heating food, a high voltage transformer supplying a high voltage to the magnetron, and a control unit enabling switching between presence/absence of power supply from a prescribed AC power source to the high voltage transformer and capable of detecting a power supply voltage phase, that is, the phase of the voltage supplied by the prescribed AC power source. The control unit starts power supply to the high voltage transformer at the power supply voltage phase that corresponds to the phase of the power supply voltage at the time when power supply to the high voltage transformer is stopped last time.

According to the present invention, from the phase of the power supply voltage at the time when power supply to the high voltage transformer is stopped last time, the state of residual magnetic flux at the start of power supply in the high voltage transformer can be expected.

Therefore, power supply to the high voltage transformer is possible while considering the state of residual magnetic flux, and hence, rush current in the high voltage transformer can be suppressed.

According to another aspect, the microwave oven in accordance with the present invention includes a magnetron heating food, a high voltage transformer supplying a high voltage to the magnetron, and a control unit enabling switching between presence/absence of power supply from a prescribed AC power source to the high voltage transformer and capable of detecting a power supply voltage phase that is the phase of the voltage supplied by the prescribed AC power source. The control unit stops power supply to the high voltage transformer at a time point when the power supply voltage phase attains to a prescribed phase, if a condition to terminate heating by the magnetron is satisfied.

Thus, power supply to the high voltage transformer can be stopped at such a phase of the power supply voltage that suppresses rush current at the start of next power supply to the high voltage transformer.

Preferably, in the microwave oven in accordance with the present invention, the control unit starts power supply to the high voltage transformer at a time point when the power supply voltage phase is at a specific phase, if the power supply voltage phase at the time point when power supply to the high voltage transformer is stopped last time could not be detected. Accordingly, regardless of the state of residual magnetic flux in the high voltage transformer, power supply to the high voltage transformer can be started at such a power supply voltage phase that can to some extent suppress the rush current.

According to a still another aspect, the present invention provides a microwave oven including a magnetron heating food, a high voltage transformer supplying a high voltage to the magnetron, a relay capable of assuming a first state in which a prescribed AC power source is electrically connected to the high voltage transformer and a second state in which connection between the prescribed AC power source and the high voltage transformer is canceled, and a control unit controlling the operation of the relay. The control unit causes the relay to operate preliminarily from the second state toward the first state to almost establish the first state, before switching the relay from the second state to the first state.

According to the present invention, as the preliminary operation is performed, even when the relay has not being set to the first state for a long period of time, the state of the relay can be changed smooth when the control unit operates the relay from the second state to the first state. In other words, the state of the relay can always be changed smooth.

Therefore, the time period from issuance of a command from the control unit to set the relay to the first state until the relay actually assumes the first state can be made constant.

Therefore, the timing of power supply to the high voltage transformer can be precisely met.

In the microwave oven in accordance with the present invention, it is preferred that the control unit causes the relay to execute the preliminary operations a number of times.

This enables smooth operation of the relay with higher reliability.

In the microwave oven in accordance with the present invention, it is preferred that the control unit returns the relay to the second state, after the relay performed the preliminary operation.

This surely avoids such a situation in that power is accidentally supplied from the prescribed AC power source to the high voltage transformer, when only a preliminary operation of the relay was intended.

Preferably, the microwave oven in accordance with the present invention further includes a heating chamber accommodating food, a display unit capable of displaying the state of the microwave oven, and a temperature detecting unit detecting the temperature in the heating chamber. The manner of display on the display unit is preferably changed in accordance with the temperature detected by the temperature detecting unit, after the end of heating operation by the magnetron.

Thus, even after the end of heating operation of the microwave oven, it is possible to provide a warning to the user.

Preferably, in the microwave oven in accordance with the present invention, the display unit is capable of displaying symbols, and the color of the symbols at the display unit changes in accordance with the temperature detected by the temperature detecting unit, after the end of the heating operation by the magnetron.

This allows the user to readily recognize the temperature of the heating chamber.

Preferably, in the microwave oven in accordance with the present invention, the display unit is implemented by a liquid crystal display device with a back light, and display color of the back light changes in accordance with the temperature detected by the temperature detecting unit, after the end of the heating operation by the magnetron.

This allows the user to readily recognize the temperature of the heating chamber.

Preferably, in the microwave oven in accordance with the present invention, the display unit ends the display operation, provided that the temperature detected by the temperature detecting unit attains to a prescribed temperature or lower, after the end of the heating operation by the magnetron.

Thus, at a time point when warning to the user becomes unnecessary, the display operation of the display unit ends. In other words, in the microwave oven, power consumption can be suppressed, while necessary warning is given to the user.

Preferably, in the microwave oven in accordance with the present invention, the control unit is fed by a prescribed power source, and preferably, power supply to the control unit is stopped provided that the temperature detected by the temperature detecting unit attains to a prescribed temperature or lower.

Accordingly, at the time point when warning to the user become unnecessary, power supply to the control unit ends. In other words, in the microwave oven, power consumption can be suppressed while necessary warning is given to the user.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

Figure 1:
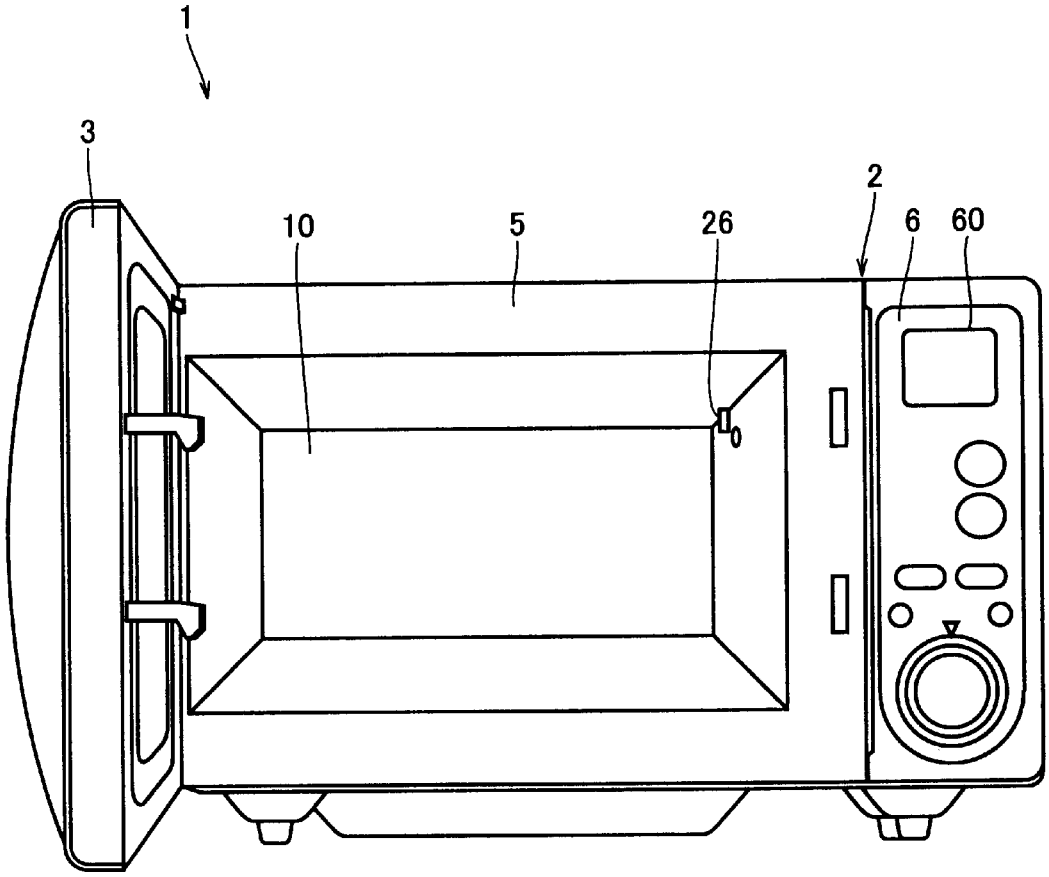
FIG. 1 is a front view of a microwave oven in accordance with the first embodiment of the present invention.

Referring to FIG. 1, a microwave oven 1 mainly includes a body 2, a door 3, and an operation panel 6. Body 2 mainly includes a body frame 5 and an outer housing covering an outer portion of the body frame 5. Inside the body frame 5, a heating chamber 10 capable of accommodating food is provided. A thermistor 26 for detecting temperature in the heating chamber 10 is provided in heating chamber 10. Door 3 is provided on a front side of body 2 to open/close the heating chamber 10.

A plurality of keys allowing input of various information by the user to the microwave oven 1 are provided on operation panel 6. Further, a display unit 60 indicating the state of microwave oven 1 such as the running time of heating/cooking is provided on operation panel 6. Display unit 60 is, for example, implemented by a liquid crystal panel, and is capable of displaying signs and symbols including numerals.

Figure 2:
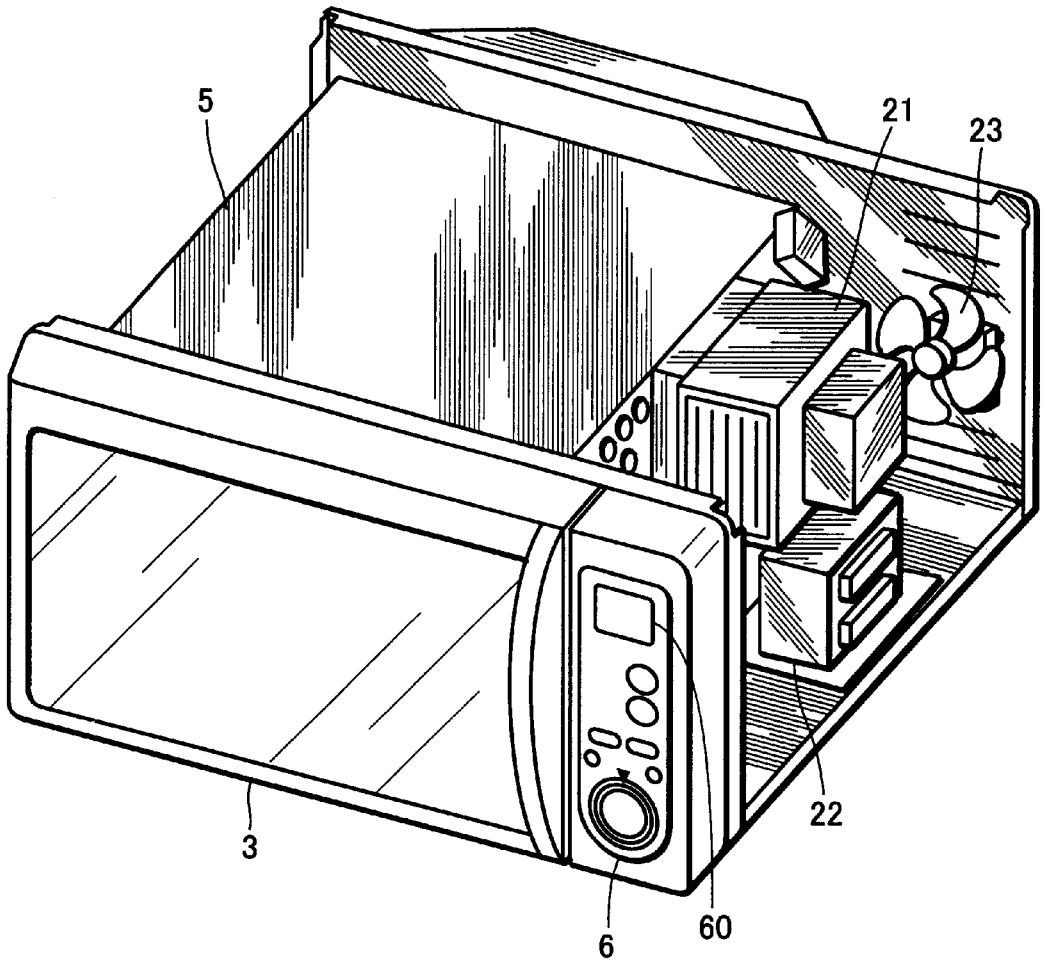
FIG. 2 is a perspective view of the microwave oven shown in FIG. 1, with an outer housing removed.

Next, referring to FIG. 2, on the body frame 5 and on the right side of heating chamber 10, there is provided a magnetron 21 for supplying microwave within the heating chamber 10. Below magnetron 21, a high voltage transformer 22 is provided, for supplying a high voltage to magnetron 21. Behind magnetron 21, a cooling fan 23 is provided for cooling magnetron 21 and high voltage transformer 22.

Figure 3:
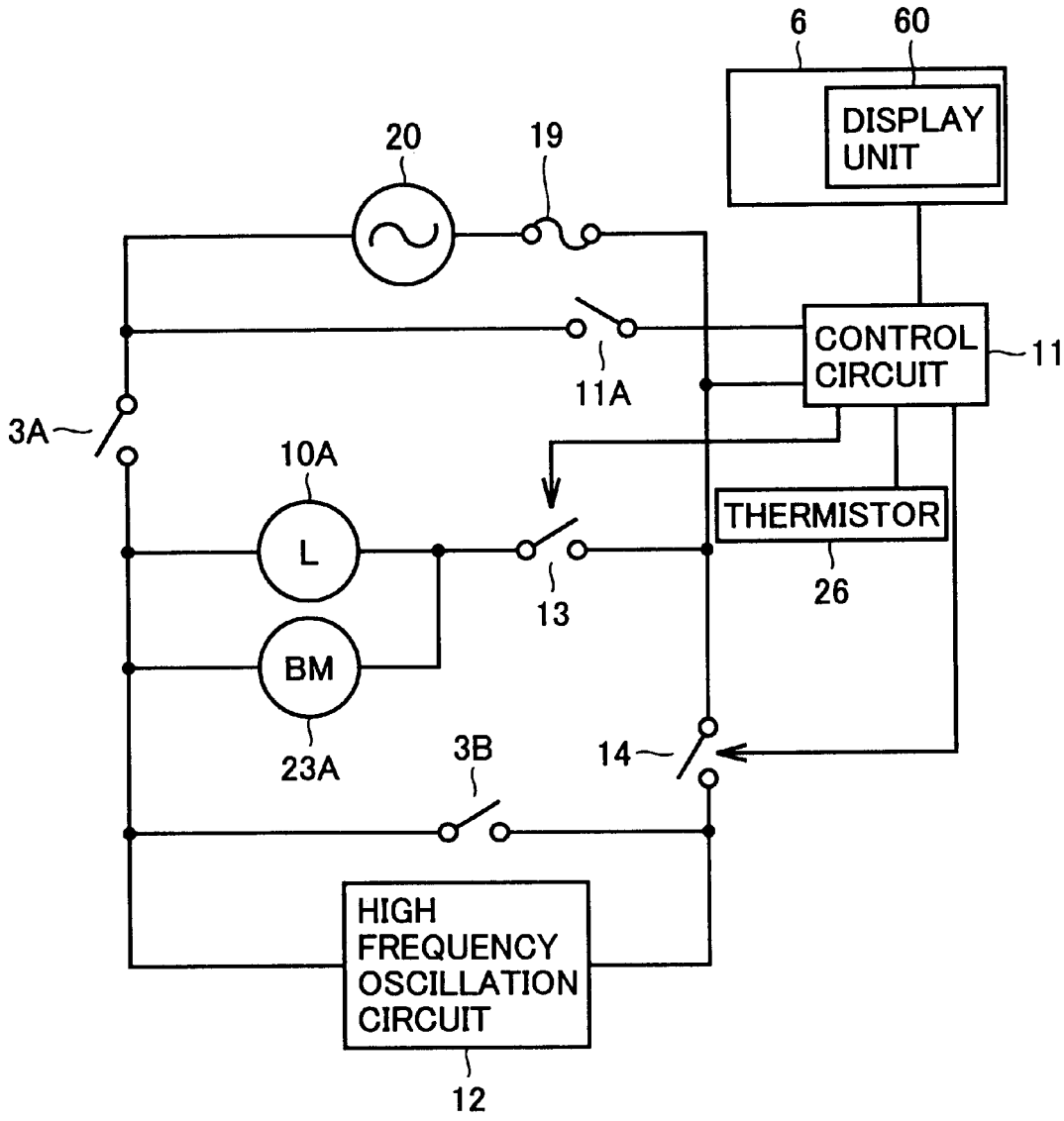
FIG. 3 shows electrical configuration of the microwave oven shown in FIG. 1.

Next, referring to FIG. 3, power is supplied from an external AC power source 20 to microwave oven 1. Microwave oven 1 includes a control circuit 10 that controls overall operation of microwave oven 1. Further, microwave oven 1 includes a chamber light 10A illuminating the heating chamber 10, a blower motor 23A rotating the cooling fan 23, and a high frequency oscillation circuit 12 oscillating the microwave from magnetron 21. High frequency oscillation circuit 12 includes magnetron 21 and high voltage transformer 22.

Microwave oven 1 further includes a door switch 3A and a monitor switch 3B. Door switch 3A and monitor switch 3B are both linked to the opening/closing operations of door 3, to switch opening/closing of the circuit shown in FIG. 3. Door switch 3A opens the circuit when door 3 is opened, and closes the circuit when door 3 is closed. Thus, when door 3 is opened, power supply from AC power source 20 to high frequency oscillation circuit 12 becomes impossible. As door switch 3 is provided, such a situation in that magnetron 21 oscillates the microwave while the door 3 is open, can be avoided. Monitor switch 3B opens the circuit when door 3 is closed, and closes the circuit when door 3 is opened. As monitor switch 3B is provided, even in such a situation in that the circuit is not opened by door switch 3A because of adhesion or the like while door 3 is open, fuse 19 is blown off, and hence power supply from AC power source 20 to high frequency oscillation circuit 12 is disabled.

Microwave oven 1 further includes switches 13 and 14. Switch 13 is for switching power supply to chamber light 10A and blower motor 23A. Switch 14 switches power supply to high frequency oscillation circuit 12. Opening/closing of the circuits of switches 13 and 14 are both controlled by control circuit 11. Control circuit 11 is connected to operation panel 6 and thermistor 26, and it is capable of inputting/outputting information therewith.

Further, a fuse 19 is connected in series with and adjacent to AC power source 20, in microwave oven 1. Therefore, introduction of hazardous high current from AC current 20 to microwave oven 1 can be avoided.

Microwave oven 1 further includes a switch 11A. When microwave oven 1 is in operation, control circuit 11 makes switch 11A close the circuit. When heating operation is not performed for a prescribed time period in microwave oven 1, for example, control circuit 11 makes switch 11A open the circuit, so as to stop power supply to control circuit 11. Accordingly, standby power requirement of microwave oven 1 can be reduced. It is noted that by a prescribed key operation on operation panel 6, it is possible for control circuit 11 to make switch 11A close the circuit.

Figure 4:
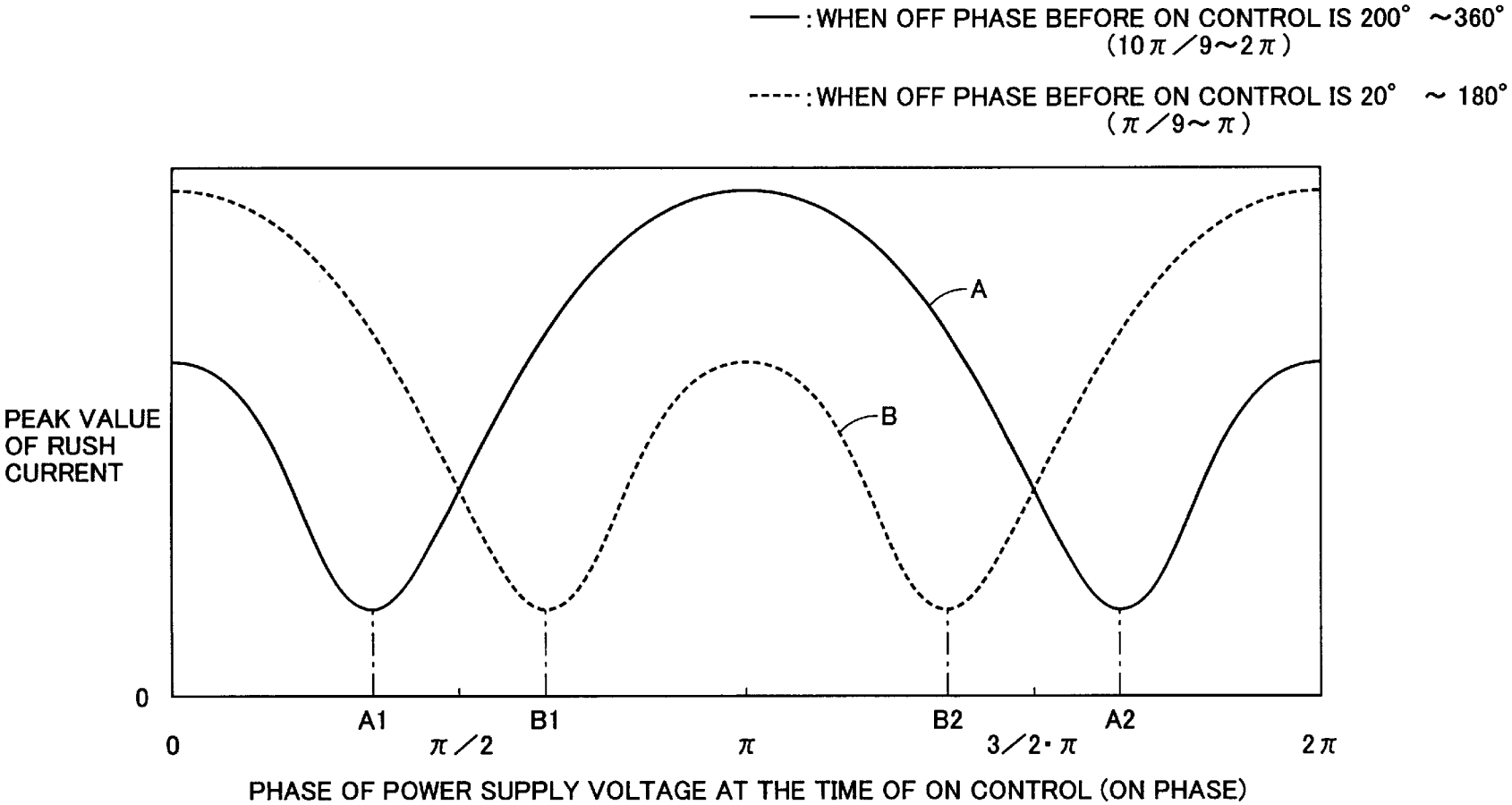
FIG. 4 is a graph representing peak value of the rush current with respect to the voltage phase of the AC power source, when power supply to a high voltage transformer of the microwave oven shown in FIG. 1 starts.

A peak value of the rush current in high voltage transformer 22 when power supply from a general AC power source to high voltage transformer 22 starts changes in accordance with the phase of the voltage of the AC power source when power supply to the high voltage transformer 22 is stopped last time (hereinafter simply referred to as "off phase"). The peak value of the rush current also changes in accordance with the phase of the voltage of the AC power source when power supply to the high voltage transformer 22 starts (hereinafter simply referred to as "on phase"). These points will be described in greater detail with reference to FIG. 4. In the following description, start of power supply to the high voltage transformer 22 is sometimes simply referred to as "on control" as appropriate. In FIG. 4, an example in which off phase immediately before on control is 200° to 360° ($10\pi/9 \sim 2\pi$) is represented by a solid line A, and an example in which the off phase is 20° to 180° ($\pi/9 \sim \pi$) is represented by a dotted line B.

The line A shows that the rush current assumes the minimum value when the on phase is A1 and A2. Here, A1 is a value slightly lower than $\pi/2$ (about $\pi/3$), and A2 is a value slightly higher than $3\pi/2$ (about $5\pi/3$). Therefore, when it is determined that the off phase is $10\pi/9 \sim 2\pi$, the control unit 11 controls power supply to the high voltage transformer 22 such that power supply starts at a timing when the phase of the power supply voltage is A1 or A2 in the next on control.

The dotted line B shows that the rush current assumes the minimum value when the on phase is B1 and B2. Here, B1 is a value slightly higher than $\pi/2$ (about $2\pi/3$) and B2 is a value slightly lower than $3\pi/2$ (about $4\pi/3$). Therefore, when control circuit 11 determines that the off phase is $\pi/9 \sim \pi$, the control circuit controls power supply to the high voltage transformer 22 such that power supply starts at a timing when the phase of the power supply voltage is B1 or B2.

The rush current assumes the maximum value when the on phase is $\pi$ for the solid line A, and when the on phase is 0 ($2\pi$) for the dotted line B. Both for the solid line A and dotted line B, the current value of the maximum rush current is about five times the minimum current value. More specifically, when the on phase is controlled in the above described manner, the effect can be attained in microwave oven 1 that the rush current can be suppressed to be about 1/5 at most.

Further, when it is determined that the off phase is out of the above described ranges, that is, when it is $0 \sim \pi/9$ or $\pi \sim 10\pi/9$, control circuit 11 controls power supply to the high voltage transformer 22 such that power supply starts at a timing when the phase of the power supply voltage assumes $\pi/2$ or $3\pi/2$ in the next on control.

As can be understood from FIG. 3, switching between presence/absence of power supply to high frequency oscillation circuit 12 is attained by opening/closing the circuit by switch 14. Switch 14 is implemented by a relay. Control circuit 11 is provided with a relay coil that corresponds to the relay constituting the switch 14. Opening/closing of the circuit by switch 14 is switched as control circuit 11 switches the state of conduction to the relay coil.

Figure 5:
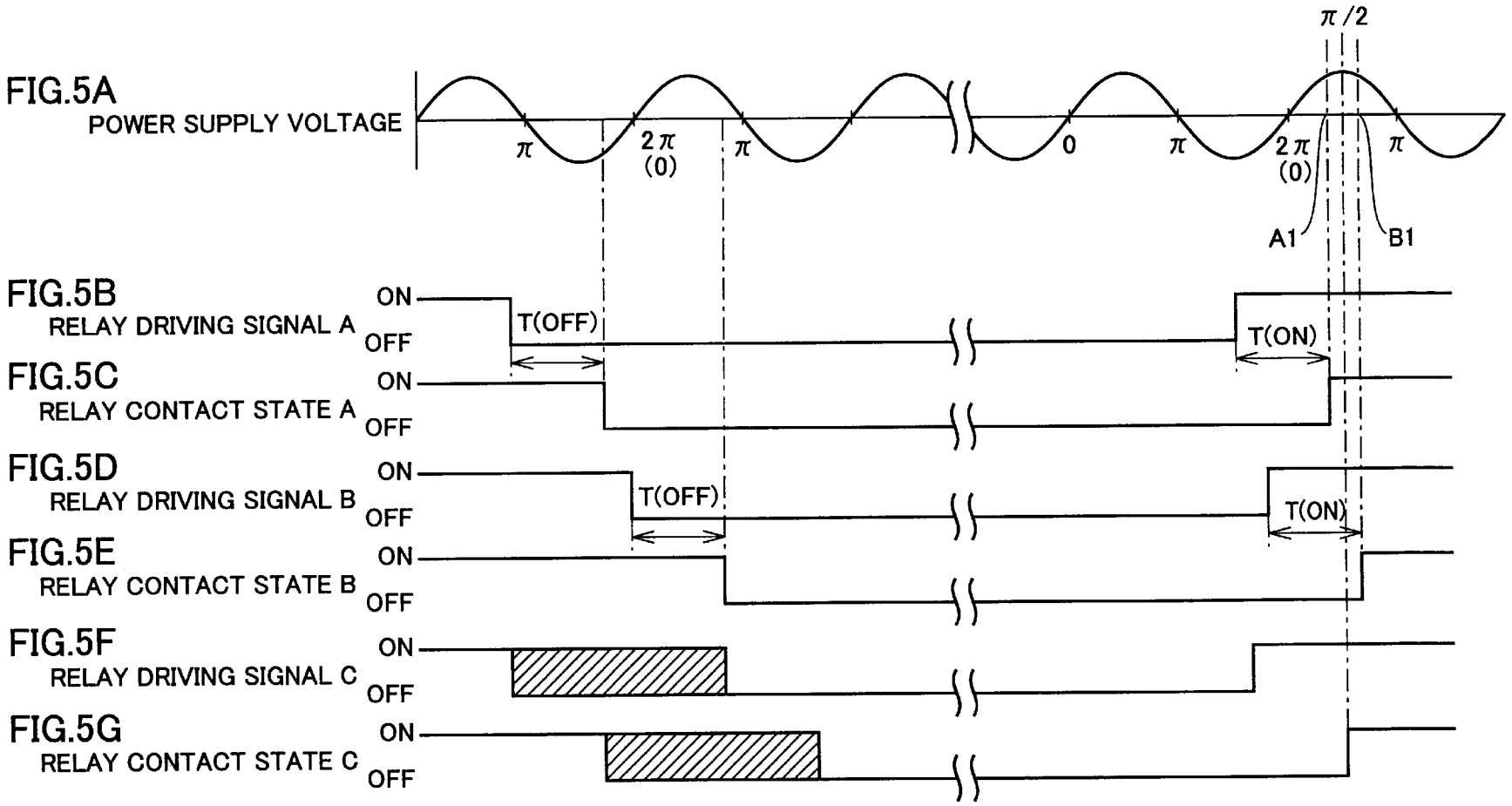
FIG. 5A shows power supply voltage waveform.
FIG. 5B shows the state of a relay driving signal.
FIG. 5C shows a state of a relay contact.
FIG. 5D shows a state of the relay driving signal.
FIG. 5E shows the state of relay contact.
FIG. 5F shows the state of the relay driving signal.
FIG. 5G shows the state of relay contact.

Control of the operation of switch 14 in accordance with the phase of the power supply voltage performed by control circuit 11 will be described in greater detail with reference to FIGS. 5A to 5G. The waveform of the power supply voltage corresponds to the time change of the voltage supplied by AC power source 20. The state of the relay driving signal refers to the timing when control circuit 11 issues a signal to make switch 14 close the circuit, that is, the timing when conduction to the relay coil starts. The relay contact state refers to the state of switch 14 opening/closing the circuit. In FIGS. 5C, 5E and 5G, when switch 14 opens the circuit, the relay contact is indicated as relay contact OFF and when the circuit is closed, the relay contact is represented as relay contact ON. FIGS. 5B to 5G show the states of the relay driving signal and a relay contact in three different patterns, that is, A to C.

First, refer to the waveform of the power supply voltage (FIG. 5A), the state of relay driving signal A (FIG. 5B) and the state of relay contact A (FIG. 5C), for the pattern A. In this pattern, relay contact is switched from ON to OFF when the phase of the power supply voltage is at $10\pi/9\sim2\pi$. Switch 14 opens the circuit after T(OFF) from the issuance of the relay driving signal by control circuit 11. When switching of the relay contact from ON to OFF is detected while the phase of the power supply voltage is $10\pi/9\sim2\pi$, control circuit 11 turns ON the relay driving signal, so that the relay contact is switched from OFF to ON while the phase of the power supply voltage is A1. The relay contact is switched to ON after T(ON) from the issuance of the relay driving signal.

Next, refer to the waveform of the power supply voltage (FIG. 5A), the state of the relay driving signal B (FIG. 5D) and the state of the relay contact B (FIG. 5E) for the pattern B. In this pattern, the relay contact is switched from ON to OFF, when the phase of the power supply voltage is $\pi/9\sim\pi$. Here, switch 14 opens the circuit after T(OFF) from the issuance of the relay driving signal by control circuit 11. When switching from ON to OFF of the relay contact is detected while the phase of the power supply voltage is $\pi/9\sim\pi$, control circuit 11 turns ON the relay driving signal, so that the relay contact is switched from OFF to ON while the phase of the power supply voltage is B1.

Next, refer to the waveform of the power supply voltage (FIG. 5A), the state of the relay driving signal C (FIG. 5F) and the state of the relay contact C (FIG. 5G), for the pattern C. This pattern represents an example in which control circuit 11 could not detect the phase of the power supply voltage at the time point when the relay contact was switched from ON to OFF. In this state, control circuit 11 turns ON the relay driving signal so that the relay contact is switched from OFF to ON at a time point when the phase of the power supply voltage is $\pi/2$. When the phase of the power supply voltage is $\pi/2$, the peak value of the rush current cannot be an extremely high value, no matter whether the operation corresponds to the solid line A or the dotted line B of FIG. 4. More specifically, either for the solid line A or the dotted line B of FIG. 4, the peak value of the rush current can be suppressed to about half the maximum value. From the same reasons, the relay contact may be switched from OFF to ON at a time point when the phase of the power supply voltage is $3\pi/2$.

As described above, control circuit 11 controls the operation of switch 14 so that the peak value of the rush current to high voltage transformer 22 is suppressed. Namely, in a common heating/cooking operation, when heating for a predetermined time period in accordance with a recipe or the like terminates, control circuit 11 makes switch 14 open the circuit when the phase of the power supply voltage attains to $10\pi/9\sim2\pi$ or $\pi/9\sim\pi$, and stops power supply to the high frequency oscillation circuit 12 (high voltage transformer 22).

When power supply to high voltage transformer 22 is stopped when the phase of the power supply voltage is out of the ranges $0\sim\pi/9$ and $\pi\sim10\pi/9$, as experienced when the door 3 is opened during the heating/cooking operation, for example, control circuit 11 detects the phase of the power supply voltage at the time point when switch 14 opened the circuit. In accordance with this phase of the power supply voltage, the control circuit adjusts the timing at which switch 14 closes the circuit next time (pattern A or pattern B). As the timing at which switch 14 closes the circuit is controlled in this manner, rush current to the high voltage transformer 22 can be suppressed to about 1/5 (see FIG. 4).

Here, when control circuit 11 could not detect the phase of the power supply voltage at the time point when switch 14 opened the circuit last time, then the control circuit 11 makes switch 14 close the circuit while the phase of the power supply voltage is $\pi/2$ or $3\pi/2$ (pattern C). Simply by such a control, the rush current in the high voltage transformer 22 can be suppressed to about one half the maximum value. Namely, the rush current in the high voltage transformer 22 can be suppressed to about 1/2.5.

Figure 6:
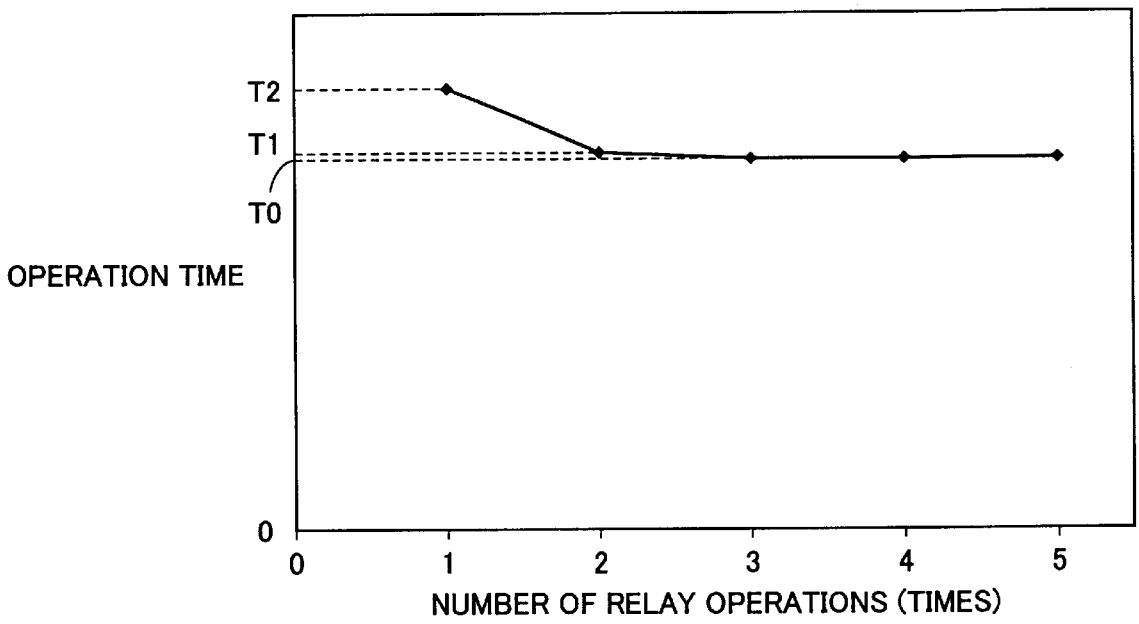
FIG. 6 is a graph representing change in time (operation time) from the start of power supply to a relay coil until actual dosing of the circuit, in a relay switching presence/absence of power supply to a high voltage oscillation circuit in the microwave oven shown in FIG. 1, when circuit opening/dosing operations are performed continuously after opening/closing of the circuit was stopped for a long period of time.

As already described, switch 14 is implemented by a relay. When opening/closing of the circuit by switch 14 is not performed for a long period of time, it is expected that the operation of the relay constituting the switch 14 becomes dull. A method of avoiding such a situation will be described with reference to FIG. 6. In FIG. 6, the ordinate represents operation time and the abscissa represents the number of operations of switch 14 (relay) when opening/closing of the circuit was not performed for a long period of time.

Referring to FIG. 6, the operation time of the relay is T2 (about 10.4 msec) in the first trial, T1 (about 8.8 msec) in the second trial, and T0 (about 8 msec) for the third and the following trials. It can be understood from the results that when the switch 14 does not perform the circuit opening/dosing operation for a long period of time, the operation time of switch 14 becomes unstable.

Therefore, in microwave oven 1, when heating operation by magnetron 21 is to be started, switch 14 is caused to perform a preliminary operation, and then the circuit shown in FIG. 3 is closed. The preliminary operation will be described in greater detail, with reference to the timing charts of FIGS. 7A to 7C. Switches 13 and 14 are both implemented by relays, and the signals shown in FIGS. 7A and 7B relate to ON/OFF of power conduction to the relay coils for driving the corresponding relays.

At the start of heating operation, first, control circuit 11 causes switch 13 to close the circuit, by turning ON the relay driving signal for switch 13. Consequently, chamber light 10A is turned on, and cooling fan 23 starts rotation.

Thereafter, control circuit 11 turns and keeps ON for the time period TX the relay driving signal for switch 14. Thus, switch 14, which has been in such a state that opens the circuit of FIG. 3 is moved to the direction of closing the circuit only for the time period TX (corresponding to the pulse J1 of FIG. 7B). If when power is supplied for the period TX to the corresponding relay coil, switch 14 is not so much moved as to close the circuit shown in FIG. 3. Thereafter, control circuit 11 turns and keeps OFF the relay driving signal for switch 14 for the time period TY. Consequently, switch 14 moves to the direction of opening the circuit shown in FIG. 3. Here, after switch 14 moves to the direction of closing the circuit shown in FIG. 3 for the time period TX and power supply to the corresponding relay coil is stopped for the period TY, switch 14 is fully set to the state of opening the circuit of FIG. 3. Thereafter, control circuit 11 continuously keeps ON the relay driving signal for switch 14, so that switch 14 closes the circuit of FIG. 3.

More specifically, in microwave oven 1, switch 14 is forced to make a preliminary movement corresponding to J1, before continuously closing the circuit. Accordingly, even when switch 14 has been inoperable for a long period of time, the operation of switch 14 can be made smooth before closing the circuit shown in FIG. 3 to supply power to the high voltage transformer 22. Therefore, the timing at which control circuit 11 causes switch 14 to close the circuit shown in FIG. 3, that is, the timing of starting power supply to high voltage transformer 22 can be controlled accurately.

Figures 7A, 7B, 7C:
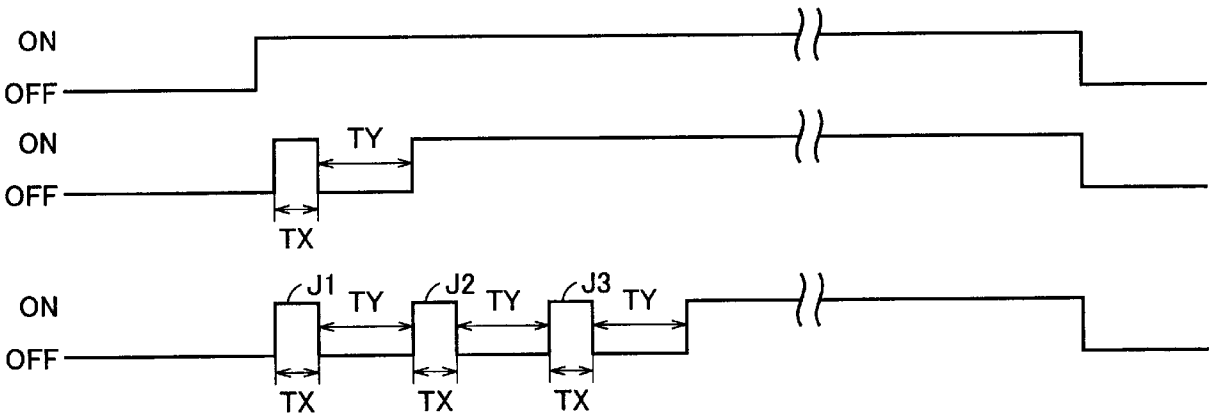
FIG. 7A is a timing chart of a signal for switching an operation of a switch 13.
FIGS. 7B and 7C are timing charts of signals for switching an operation of a switch 14.

The above described preliminary movement is not limited to one time such as shown in FIG. 7B. FIG. 7C is a timing chart showing a modification of FIG. 7B. The preliminary movement may be performed for a number of times as represented by J1 to J3 in FIG. 7C.

The contents of processing performed by control circuit 11 when heating operation is performed by microwave oven 1 will be described with reference to FIG. 8.

Figure 8:
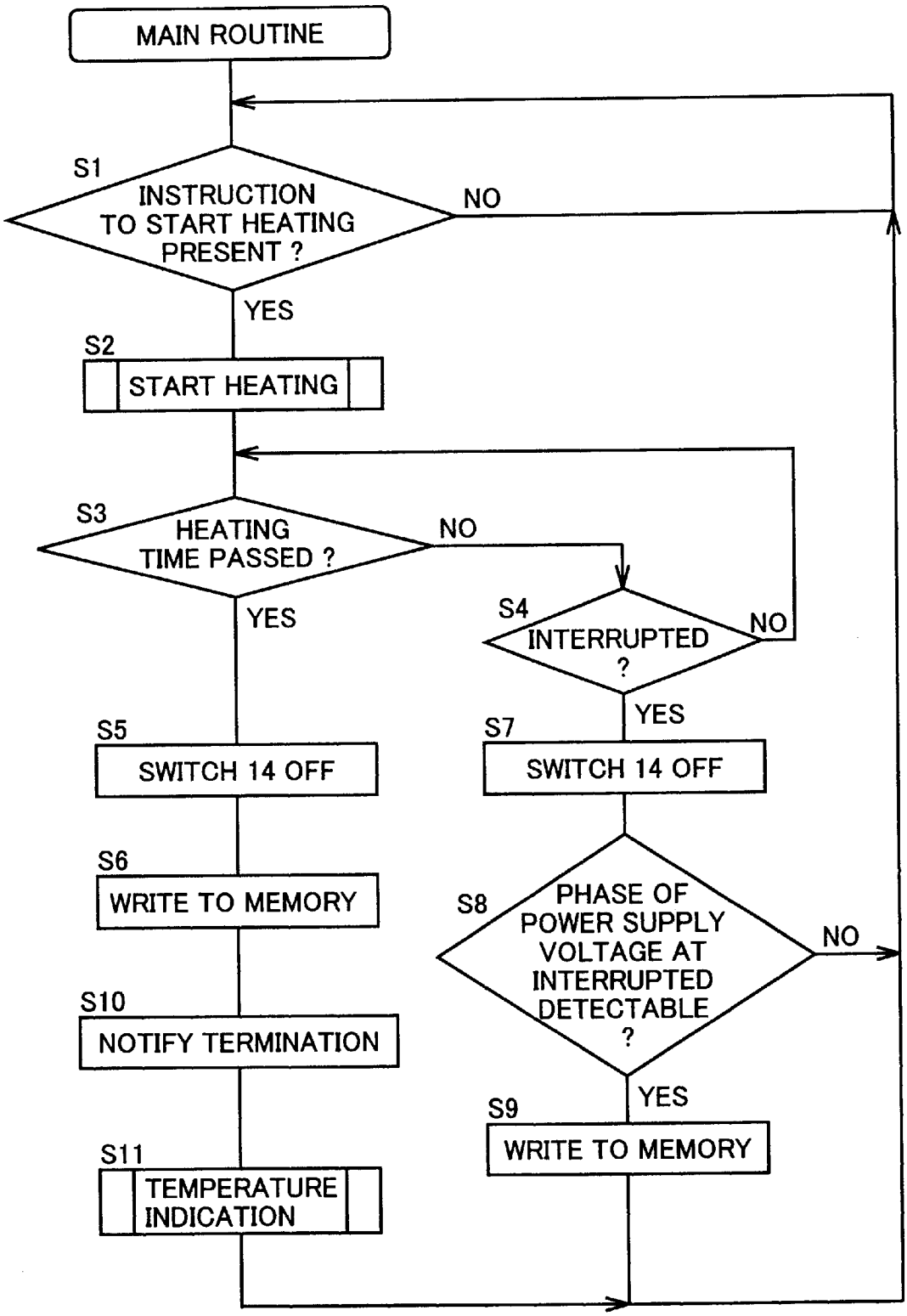
FIG. 8 is a flow chart of a main routine executed by a control circuit of the microwave oven shown in FIG. 1.

Referring to FIG. 8, first, control circuit 11 determines in S1 whether an operation instructing start of a heating operation has been made by operation panel or not. When it is determined that the operation is done, the process proceeds to S2.

In S2, control circuit 11 performs a process for starting heating, so that magnetron 21 starts heating, and thereafter the process proceeds to S3. Details of the process for starting heating will be described later.

In S3, control circuit 11 determines whether a predetermined heating time has passed from the start of heating in S2, or whether an operation to terminate heating operation has been done by operation panel 6 or not. When it is determined that the heating time has not yet passed and that an operation for terminating heating operation has not being done, the process proceeds to S4. When it is determined that the heating time has passed, or an operation for terminating the heating operation has been made, the process proceeds to S5. Microwave oven 1 is capable of performing heating/cooking in accordance with a plurality of recipes, and the heating time is determined differently in accordance with the recipe.

In S5, control circuit 11 makes switch 14 open the circuit shown in FIG. 3, so that power supply to high frequency oscillation circuit 12 is stopped, and thereafter the process proceeds to S6. Here, control circuit 11 makes switch 14 open the circuit when the phase of the voltage of AC power source 20 is at $10\pi/9$ to $2\pi$ or $\pi/9\sim\pi$.

In S6, control circuit 11 writes the phase of the voltage of AC power source 20 ($10\pi/9\sim2\pi$ or $\pi/9\sim\pi$) when the switch 14 opened the circuit in step S5, in a built-in memory, and the process proceeds to S10.

In S4, control circuit 11 determines whether power supply to high frequency oscillation circuit 12 is interrupted or not as the door 3 is opened, for example. If there is such an interruption, the flow proceeds to S7, and otherwise, the process returns to S3.

In step S7, control circuit 11 makes switch 14 open the circuit shown in FIG. 3, and thereafter, the process proceeds to S8. Accordingly, in microwave oven 1, heating operation is performed, provided that an operation instructing start of heating again is made, if there has been an interruption of heating.

In S8, control circuit 11 determines whether it is possible or not to detect the phase of the voltage supplied by AC power source 20 at the time point when heating was interrupted. If it can be detected, the detected phase is written to the built-in memory in S9, and the process returns to S1. If detection is not possible, the process directly returns to S1.

In S10, control circuit 11 notifies by voice or display, that heating is terminated, and thereafter the process proceeds to S11.

In S11, control circuit 11 performs a temperature indicating process in which the manner of display on display unit 60 is changed in accordance with the temperature of heating chamber 10, and the process returns to S1, in which the control circuit waits for an operation instructing heating. Details of the temperature indicating process will be described later.

Figure 9:
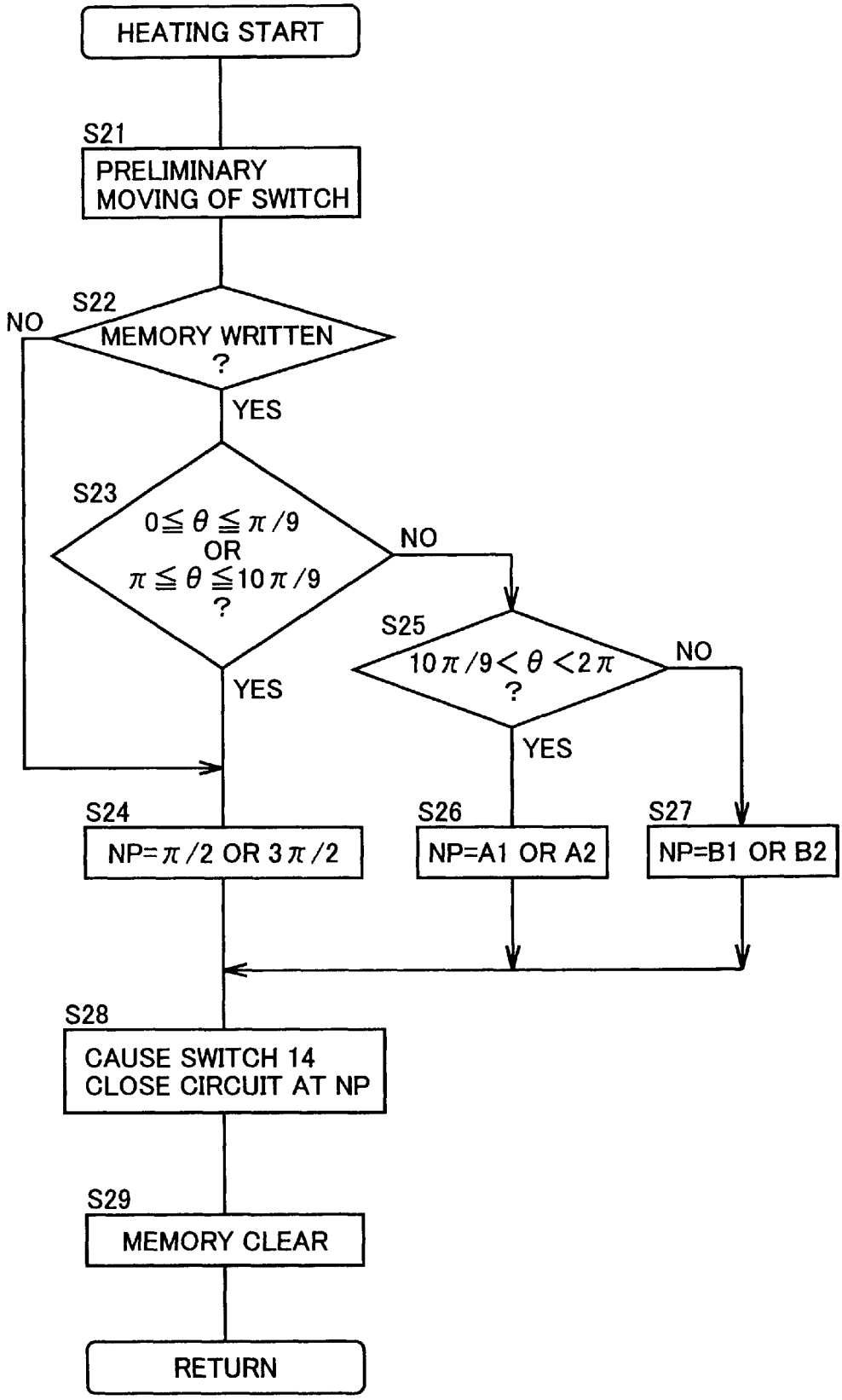
FIG. 9 is a flow chart of a sub routine of heating start process shown in FIG. 8.

The contents of the heating start process of step S2 will be described with reference to FIG. 9.

In the heating start process, first in step S21, control circuit 11 causes switch 14 to move preliminary as described with reference to FIGS. 7A to 7C, and the process proceeds to S22.

In S22, control circuit 11 determines whether or not the phase of the voltage of AC power source 20 when conduction to high voltage transformer 22 was stopped has been written in the built-in memory. When it is determined that the phase is written, the process proceeds to S23, and when it is determined that the phase is not written, the process proceeds to S24.

In S23, control circuit 11 determines whether the phase $\theta$ written in the memory is in the range of $0\sim\pi/9$ or $\pi\sim10\pi/9$. When it is determined that the phase is within the range, the process proceeds to S24, and otherwise, the process proceeds to S25.

In S25, control circuit 11 determines whether the phase $\theta$ written in the memory is within the range of $10\pi/9<\theta<2\pi$. When it is determined that it is within the range, the process proceeds to S26, and otherwise, the process proceeds to S27.

In each of the steps S24, S26 and S27, control circuit 11 determines the phase NP of the voltage of AC power source 20 at the time when switch 14 is caused to close the circuit shown in FIG. 3 to be $\pi/2$ or $3\pi/2$, A1 or A2, B1 or B2, and the process proceeds to S28.

In S28, control circuit 11 causes switch 14 to close the circuit shown in FIG. 3 at the NP determined in S24, S26 or S27, in S29, the phase written in the memory is cleared, and the process returns.

Figure 10:
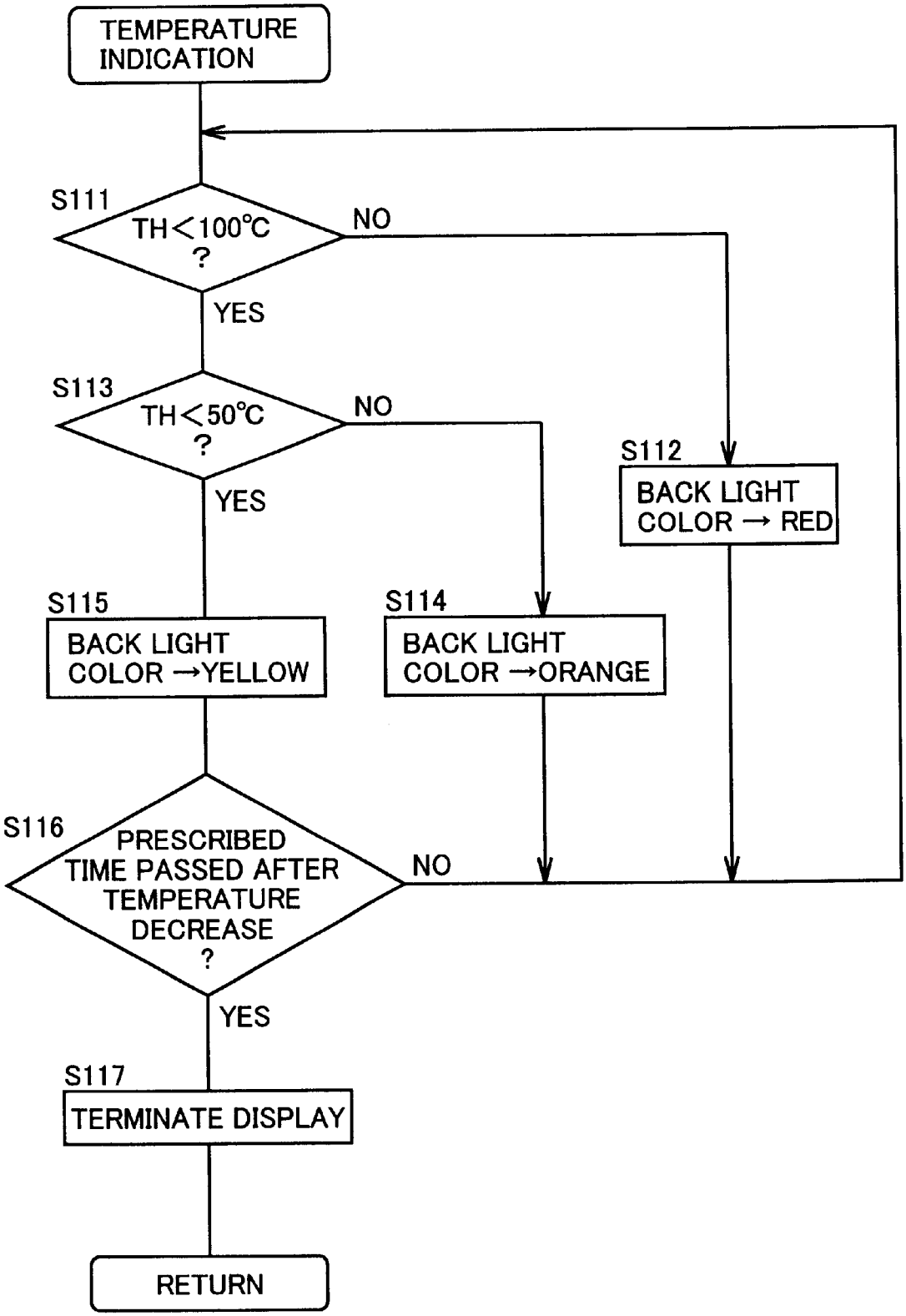
FIG. 10 is a flow chart of a sub routine of temperature indicating process shown in FIG. 8.
Figures 11A, 11B:
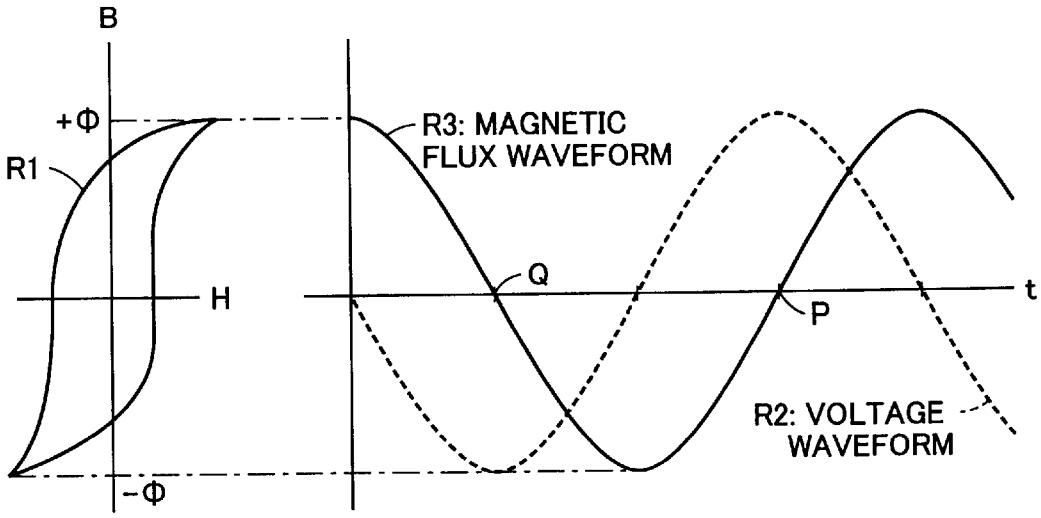
FIG.11A PRIOR ART
FIG.11B PRIOR ART
FIGS. 11A and 11B represent characteristics of a high voltage transformer in a general microwave oven.

Next, the temperature indicating process of S11 of FIG. 8 will be described with reference to FIG. 10.

In the temperature indicating process, control circuit 11 first determines whether the temperature TH detected by thermistor 26 is lower than 100° C. or not, in S111. When it is determined that the temperature is lower than 100° C., the process proceeds to S113, and when it is determined that the temperature is not lower than 100° C., the process proceeds to S112.

In S112, control circuit 11 sets the color of the back light of display unit 60 to red, and the process returns to S111.

In S113, control circuit 11 determines whether the temperature TH detected by thermistor 26 is lower than 50° C. or not. When it is determined that the temperature is still not lower than 50° C., the process proceeds to S114 in which the color of the back light of display unit 60 is set to orange, and the process returns to S111.

When it is determined that the temperature becomes lower than 50° C., the process proceeds to S115.

In S115, control circuit 11 sets the color of the back light of display unit 60 to yellow, and the process proceeds to S116.

In S116, control circuit 11 determines whether or not a prescribed time period (for example, 3 minutes) has passed after the temperature TH detected by thermistor 26 attained lower than 50° C. When it is determined that the prescribed time period has not yet passed, the process returns to S111. When it is determined that the prescribed time period has passed, the process proceeds to S117. In S117, the display on the display unit 60 is terminated, and the process returns.

In accordance with the temperature indicating process described above, when TH is not lower than 100° C., the back light color of display unit 60 is red. When TH is between 50° C. to 100° C., the back light color of display unit 60 is orange. When TH is lower than 50° C., the back light color of display unit 60 is yellow. Accordingly, even after the heating/cooking operation, it is possible to notify the temperature of heating chamber 10 to the user in an indirect manner. Thus, accidental touching of the heating chamber 10 or microwave oven 1 by the user not knowing that the heating chamber 10 is at a high temperature can be avoided.

When a prescribed time has passed after TH becomes lower than 50° C., the display on display unit 60 is stopped. Thus, unnecessary display operation by display unit 60 is avoided. Therefore, in microwave oven 1, unnecessary power consumption can be avoided, while giving necessary warning to the user that the heating chamber 10 is hot.

Here, control circuit 11 changes the color of display of the back light on display unit 60 in accordance with the temperature TH. Alternatively, the color of characters or numerals displayed on display unit 60 may be changed.

In S117, instead of terminating the display operation at display unit 60, control circuit 11 may cause switch 11A to open the circuit, so as to stop power supply to the control circuit 11. That the power supply to control circuit 11 is stopped means that power supply to microwave oven 1 is stopped.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A microwave oven, comprising:

a magnetron heating food;

a high voltage transformer supplying a high voltage to said magnetron; and a control unit enabling switching between presence/absence of power supply from a prescribed AC power source to said high voltage transformer, and capable of detecting power supply voltage phase as a phase of the voltage supplied by said prescribed AC power source; wherein said control unit starts power supply to said high voltage transformer with a power supply voltage phase in accordance with said power supply voltage phase at a time point when power supply to said high voltage transformer is stopped last time.

2. The microwave oven according to claim 1, wherein said control circuit starts power supply to said high voltage transformer at a time point when said power supply voltage phase is at a specific phase, if said power supply voltage phase at a time point when power supply to said high voltage transformer is stopped last time cannot be detected.

3. A microwave oven according to claim 1, further comprising:

a heating chamber accommodating food;

a display unit capable of displaying a state of said microwave oven; and a temperature detecting unit detecting a temperature in said heating chamber; wherein manner of display on said display unit changes in accordance with a temperature detected by said temperature detecting unit, after termination of heating by said magnetron.

4. The microwave oven according to claim 3, wherein said display unit is capable of displaying symbols, and display color of the symbols on said display unit changes in accordance with the temperature detected by said temperature detecting unit, after termination of heating by said magnetron.

5. The microwave oven according to claim 3, wherein said display unit is implemented by a liquid crystal display device with a back light, and display color of said back light changes in accordance with the temperature detected by said temperature detecting unit, after termination of heating by said magnetron.

6. The microwave oven according to claim 3, wherein said display unit terminates displaying operation, provided that the temperature detected by said temperature detecting unit attains to a prescribed temperature or lower, after termination of heating by said magnetron.

7. The microwave oven according to claim 3, wherein said control unit is supplied with power from a prescribed power source, and power supply to the control unit is terminated provided that the temperature detected by said temperature detecting unit attains to a prescribed temperature or lower.

8. A microwave oven, comprising:

a magnetron heating food;

a high voltage transformer supplying a high voltage to said magnetron; and a control unit enabling switching between presence/absence of power supply from a prescribed AC power source to said high voltage transformer, and capable of detecting a power supply voltage phase as a phase of the voltage supplied by said prescribed AC power source; wherein said control unit stops power supply to said high voltage transformer at a time point when said power supply voltage phase attains to a prescribed phase, if a condition to terminate heating by said magnetron is satisfied.

9. The microwave oven according to claim 8, wherein said control circuit starts power supply to said high voltage transformer at a time point when said power supply voltage phase is at a specific phase, if said power supply voltage phase at a time point when power supply to said high voltage transformer is stopped last time cannot be detected.

10. A microwave oven according to claim 8, further comprising:

a heating chamber accommodating food;

a display unit capable of displaying a state of said microwave oven; and a temperature detecting unit detecting a temperature in said heating chamber; wherein manner of display on said display unit changes in accordance with a temperature detected by said temperature detecting unit, after termination of heating by said magnetron.

11. The microwave oven according to claim 10, wherein said display unit is capable of displaying symbols, and display color of the symbols on said display unit changes in accordance with the temperature detected by said temperature detecting unit, after termination of heating by said magnetron.

12. The microwave oven according to claim 10, wherein said display unit is implemented by a liquid crystal display device with a back light, and display color of said back light changes in accordance with the temperature detected by said temperature detecting unit, after termination of heating by said magnetron.

13. The microwave oven according to claim 10, wherein said display unit terminates displaying operation, provided that the temperature detected by said temperature detecting unit attains to a prescribed temperature or lower, after termination of heating by said magnetron.

14. A microwave oven, comprising:

a magnetron heating food;

a high voltage transformer supplying a high voltage to said magnetron;

a relay capable of assuming a first state in which a prescribed AC power source is electrically connected to said high voltage transformer, and a second state in which connection between said prescribed AC power source and said high voltage transformer is canceled; and a control unit controlling an operation of said relay; wherein said control unit controls said relay to perform under a preliminary operating condition from said second state working toward said first state but not reaching said first state, followed by switching from the preliminary operating condition to said first state.

15. The microwave oven according to claim 14, wherein said control unit makes said relay perform said preliminary operating condition a plurality of times.

16. The microwave oven according to claim 14, wherein said control unit returns said relay to said second state, after said relay performs said preliminary operating condition.

17. A microwave oven according to claim 14, further comprising:

a heating chamber accommodating food;

a display unit capable of displaying a state of said microwave oven; and a temperature detecting unit detecting a temperature in said heating chamber; wherein manner of display on said display unit changes in accordance with a temperature detected by said temperature detecting unit, after termination of heating by said magnetron.

18. The microwave oven according to claim 17, wherein said display unit is capable of displaying symbols, and display color of the symbols on said display unit changes in accordance with the temperature detected by said temperature detecting unit, after termination of heating by said magnetron.

19. The microwave oven according to claim 17, wherein said display unit is implemented by a liquid crystal display device with a back light, and display color of said back light changes in accordance with the temperature detected by said temperature detecting unit, after termination of heating by said magnetron.

20. The microwave oven according to claim 17, wherein said display unit terminates displaying operation, provided that the temperature detected by said temperature detecting unit attains to a prescribed temperature or lower, after termination of heating by said magnetron.

* * * * *